United States Patent [19]

Sausner et al.

[11] Patent Number: 4,617,505

[45] Date of Patent: Oct. 14, 1986

[54] VOLTAGE SUPPLY

[75] Inventors: Andreas Sausner, Frankfurt am Main; Gerhard Ruschek, Hattersheim, both of Fed. Rep. of Germany

[73] Assignee: VDO Adolf Schindling AG, Frankfurt am Main, Fed. Rep. of Germany

[21] Appl. No.: 722,958

[22] Filed: Apr. 12, 1985

[30] Foreign Application Priority Data

Apr. 14, 1984 [DE] Fed. Rep. of Germany ..... 3414211

[51] Int. Cl.[4] ..... G05G 5/00

[52] U.S. Cl. ..... 318/626; 318/672; 318/467; 318/468

[58] Field of Search ..... 318/626, 672, 661, 466, 318/467, 468, 282, 293; 49/31

[56] References Cited

U.S. PATENT DOCUMENTS 3,851,125 11/1974 Deming ..... 318/468 X

*Primary Examiner*—William M. Shoop, Jr.
*Assistant Examiner*—Patrick C. Keane
*Attorney, Agent, or Firm*—Martin A. Farber

[57] ABSTRACT

A voltage supply for a servomotor (9) is effected via a wiper (10) which slides on two conductive paths (5, 6) which are displaceable in longitudinal direction. The conductive paths (5, 6) have, at their opposite ends, a driver (15, 17) against which the wiper (10) can come in its end positions upon further displacement, in order to be able to carry the corresponding conductive path (5, 6) along with it. Directly before the driver (15, 17) is reached, no voltage is tapped off from the corresponding conductive path (5, 6), so that the servomotor (9) then stops.

4 Claims, 1 Drawing Figure

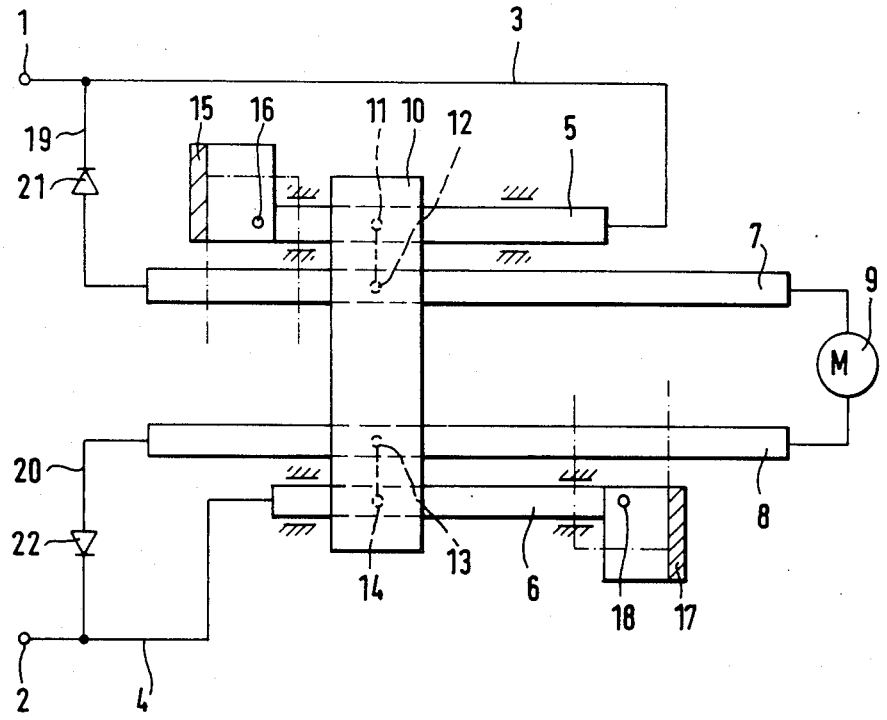
1
3
15
16
11
10
12
5
19
21
7
9
M
20
22
8
13
14
6
18
17
2
4

VOLTAGE SUPPLY

The present invention relates to a voltage supply for a servomotor which moves a setting member as in an automotive speed control device, up to at least one stop, said supply having a wiper with two wiper contacts which slide on two conductive paths which are connected to a source of voltage and via which the servomotor is supplied with voltage, at least one wiper contact of the wiper being displaceable, beyond at least one end of the conductive paths, in order to disconnect the servomotor.

Voltage supplies of this kind are customary, for instance, for speed-governing devices in automotive vehicles. In such speed-governing devices, a servomotor, based on setting commands, controls the position of the throttle valve in the air-intake port of the automotive vehicle. The two end positions of such a throttle valve are determined by stops. It is necessary, on the one hand, that the throttle valve come as precisely as possible into its end positions while, on the other hand, the servomotor must disconnect precisely at the end position since otherwise the transmission members would be damaged.

The exact reaching of end positions is important also in numerous other applications. Due to the tolerances of the setting members, transmission members and control electronics, it is necessary to provide an adjustment device which enables alignment to be effected after the assembly of all components. Such adjustment work is necessarily time-consuming and can be carried out only upon the completion of assembly, which is undesirable.

In the case of certain setting members, the end positions are also determined by limit switches. These switches however must be positioned very accurately, thereby requiring adjustment work. In addition, there is the expense for the wiring of the limit switches.

The object of the invention is to develop a voltage supply for a servomotor in such a manner that at least one end position can be precisely reached with the least possible adjustment work.

This object is achieved in accordance with the invention, by the provision of at least one conductive path which is displaceable in longitudinal direction, there being a driver connected to the path by which the path is carried along by a wiper as soon as contact of the wiper is outside the conductive path.

In one such voltage supply, automatic adjustment of the servomotor is obtained if the setting member is moved manually against a stop, since the voltage supply is also displaced corresponding to the displacement of the wiper. In this way, the end position is fixed in very simple manner and the servomotor is reliably disconnected when the end position is reached.

For numerous applications, it is advantageous for both conductive paths to be displaceable and to have a driver. Such automatic adjustment of two end positions is advantageous, for instance, in the case of setting members for speed-governing systems in automotive vehicles.

After an end position has been reached, the servomotor can start up in simple fashion in the opposite direction of rotation if each of the voltage paths over the wiper contacts has a bridging wire with diode, both diodes blocking in the same direction.

It is favorable from a design standpoint if two fixed conductive paths are provided between the displaceable conductive paths of the wiper contacts and if the wipers are each connected with a separate additional wiper contact which slides on a fixed conductive path.

The invention permits of numerous embodiments. In order to explain its basic principle, one embodiment has been shown in diagrammatic form in the drawing and will be described below. The drawing shows a servomotor having the voltage supply in accordance with the invention.

Wires 3, 4 lead from terminals 1, 2 to conductive elements or paths 5, 6 respectively. Both conductive paths 5, 6 are displaceable in longitudinal direction. Parallel to the displaceable conductive paths 5, 6 there are arranged stationary conductive paths 7, 8 respectively. A servomotor 9 is supplied with voltage via the stationary conductive paths 7, 8.

A wiper 10 is arranged for displacement on the conductive paths 5–8. The wiper has four wiper contacts 11–14, the wiper contact 11 sliding on the conductive path 5, the wiper contact 12 on the conductive path 7, the wiper contact 13 on the conductive path 8 and the wiper contact 14 on the conductive path 6. The two outer wiper contacts 11, 12 and 13, 14 respectively are connected electrically to each other.

At the left-hand end of the upper displaceable conductive path 5 as seen in the drawing, and at a slight distance from the conductive path, there is provided a driver 15. The wiper 10 can come against the driver 15 when the wiper contact 11 has left the conductive path 5 and come upon a safety contact 16 which is not connected electrically to the conductive path 5, in which connection no tapping of electric signals of the conductive path can take place.

On the other movable conductive path 6, a corresponding driver 17 is provided at its right-hand end, against which driver the wiper 10 can come in its other end position when the wiper contact 14 is on a safety contact 18. In this connection no tapping of electric signals of the conductive path takes place either.

It is furthermore important that the two stationary conductive paths 7, 8 be connected to the terminals 1 and 2 by bridging wire 19, 20, respectively. In each of these bridging lines 19, 20 there is connected a respective diode 21, 22, the two diodes blocking in the direction of the servomotor 9.

Before the adjusting of a setting member the displaceable conductive paths 5, 6 are pushed, with the wiper 10 located in the middle, into such position that the two drivers 15, 17 are relatively close to the wiper 10. The setting member (not shown) is then moved by hand up into its end position. The wiper 10, which is coupled with the setting member, also moves, for instance to the left as seen in the drawing. In this way, after the driver 15 has been contacted by the wiper 10, the conductive path 5 is displaced to the left. One then moves the setting member into its other end position, as a result of which the second conductive path 6 is moved correspondingly to the right, as seen in the drawing. In this way assurance is had that the wiper contacts 11, 14 have left the conductive paths 5, 6 in both end positions and that the servomotor 9 is thereby disconnected.

The servomotor 9 is supplied with voltage in the following manner. If positive voltage is applied, for instance, to the terminal 1 then current flows over the wire 3, the conductive path 5, the wiper contacts 11, 12 and the conductive path 7 to the servomotor 9. From there the current flows to the conductive path 8 and then over the bridging wire 20 as well as over the wiper contacts 13, 14, the conductive path 6 and the line 4 to the terminal 2. The servomotor 9 therefore turns in one direction of rotation and displaces the setting member (not shown) and simultaneously the wiper 10, for instance to the left as seen in the drawing. As soon as the region of the safety contact 16 has been reached, the feeding of the current is interrupted so that the servomotor 9 stops.

If the polarity of the terminals 1 and 2 is reversed, then the servomotor 9 can turn in the opposite direction so that the wiper 10 can move to the right, as seen in the drawing, until its wiper contact 14 comes into the region of the safety contact 18 and stops. The servomotor 9 can be moved out of the end positions of the wiper 10 only by reversal of the direction of rotation.

We claim:

1. A voltage supply for a servomotor which is operative between limit stops and moves a member toward at least one stop, the supply having a wiper with two wiper contacts which slide on two spaced-apart conductive elements which serve as two electrically conductive paths, the two conductive paths being connected to a source of voltage and supplying the servomotor with voltage, and wherein at least one wiper contact of the wiper is displaceable beyond at least one end of one of the conductive paths in order to disconnect the servomotor, the improvement wherein at least one of said conductive paths is displaceable in a longitudinal direction and has a driver mounted thereon, said wiper urging said driver to drive the conductive path as soon as the wiper contact is outside of the conductive path.

2. The voltage supply according to claim 1, wherein both of said conductive paths are displaceable and each of them has a driver.

3. The voltage supply according to claim 2, wherein the wiper contacts are coupled to two voltage paths each comprising a bridging wire with a diode, the two diodes blocking in the same direction.

4. The voltage supply according to claim 1, wherein between the displaceable conductive paths, there are provided two stationary conductive paths which are connected to the servomotor; and wherein the wiper has four contacts of which two slide on said stationary conductive paths, the wiper contacts being connected in pairs wherein, in each pair, one contact is coupled to a displaceable path and the other contact is coupled to a stationary path.

* * * * *